US009272871B2

(12) United States Patent
Oberdalhoff

(10) Patent No.: US 9,272,871 B2
(45) Date of Patent: Mar. 1, 2016

(54) CLAMPING DEVICE FOR A SHAFT AND METHOD FOR CLAMPING SAME

(75) Inventor: Tim Oberdalhoff, Lienen (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 79 days.

(21) Appl. No.: 13/503,041

(22) PCT Filed: Nov. 10, 2010

(86) PCT No.: PCT/EP2010/067238

§ 371 (c)(1),
(2), (4) Date: Apr. 20, 2012

(87) PCT Pub. No.: WO2011/058073

PCT Pub. Date: May 19, 2011

(65) Prior Publication Data

US 2012/0200023 A1 Aug. 9, 2012

(30) Foreign Application Priority Data

Nov. 10, 2009 (DE) ..... 10 2009 052 411

(51) Int. Cl.
*B25B 1/06* (2006.01)
*B65H 18/02* (2006.01)

(52) U.S. Cl.
CPC .... *B65H 18/028* (2013.01); *B65H 2301/41308* (2013.01); *Y10T 29/49826* (2015.01)

(58) Field of Classification Search
USPC ..... 269/216
See application file for complete search history.

(56) References Cited

U.S. PATENT DOCUMENTS

| | | | | | |
|---|---|---|---|---|---|
| 1,997,428 | A | * | 4/1935 | Olson | 269/94 |
| 2,657,065 | A | * | 10/1953 | Wilhelm et al. | 279/16 |
| 3,326,488 | A | | 6/1967 | Klaczkiewicz | |
| 3,342,433 | A | * | 9/1967 | Klaczkiewicz | 242/542 |
| 3,373,952 | A | * | 3/1968 | Klaczkiewicz | 242/541.6 |
| 3,455,192 | A | * | 7/1969 | Klaczkiewicz et al. | 83/175 |
| 3,583,575 | A | * | 6/1971 | Jowsey et al. | 414/741 |
| 3,929,299 | A | * | 12/1975 | Walkington | 242/530 |
| 4,575,018 | A | * | 3/1986 | Ichikawa | 242/533.2 |
| 4,682,929 | A | * | 7/1987 | Kataoka | 414/589 |
| 4,697,752 | A | * | 10/1987 | Graul et al. | 242/444 |
| 4,721,293 | A | * | 1/1988 | Schron et al. | 269/32 |
| 4,875,632 | A | * | 10/1989 | Kataoka | 242/530 |
| 4,905,925 | A | * | 3/1990 | Kremar | 242/533.1 |
| 4,971,263 | A | * | 11/1990 | Belongia et al. | 242/533.4 |
| 5,316,231 | A | * | 5/1994 | Thievessen et al. | 242/559.4 |
| 6,053,804 | A | * | 4/2000 | Parulski | 451/415 |
| 6,086,010 | A | * | 7/2000 | Kayser | 242/521 |
| 6,101,908 | A | * | 8/2000 | Azkona | 81/385 |
| 6,116,588 | A | * | 9/2000 | Yamane | 269/228 |
| 6,155,515 | A | * | 12/2000 | Dorfel et al. | 242/533.2 |
| 6,260,787 | B1 | * | 7/2001 | Michel et al. | 242/530.4 |

(Continued)

FOREIGN PATENT DOCUMENTS

| | | |
|---|---|---|
| DE | 822 769 | 11/1951 |
| DE | 1 270 917 | 6/1968 |

(Continued)

*Primary Examiner* — Lee D Wilson
*Assistant Examiner* — Alvin Grant
(74) *Attorney, Agent, or Firm* — Jacobson Holman, PLLC.

(57) ABSTRACT

A device and a method for holding a shaft, preferably a winding shaft, hold the shaft in a clamping jaw. A lever, which is rotationally supported about a first axis, is moved in reference to the shaft.

16 Claims, 5 Drawing Sheets

(56) References Cited

U.S. PATENT DOCUMENTS

| | | | | |
|---|---|---|---|---|
| 6,327,943 | B1 * | 12/2001 | Wrigley et al. | 81/413 |
| 6,360,578 | B1 * | 3/2002 | Bresnahan | 72/477 |
| 6,773,310 | B2 * | 8/2004 | Davis | 439/773 |
| D532,266 | S * | 11/2006 | Archuleta et al. | D8/52 |
| 7,156,004 | B1 * | 1/2007 | Whitehead et al. | 81/420 |
| 7,191,688 | B1 * | 3/2007 | Hall, Jr. | 81/411 |
| 7,406,898 | B1 * | 8/2008 | Hall, Jr. | 81/411 |
| 8,302,898 | B2 * | 11/2012 | Tropper et al. | 242/541 |
| 8,459,625 | B1 * | 6/2013 | Hall | 269/216 |
| 8,534,168 | B2 * | 9/2013 | Marks et al. | 81/367 |
| 2002/0050543 | A1 * | 5/2002 | Romes | 242/422.5 |
| 2007/0057109 | A1 * | 3/2007 | Reinhold | 242/533.2 |

FOREIGN PATENT DOCUMENTS

| | | |
|---|---|---|
| EP | 2 030 926 | 3/2009 |
| WO | WO 98/47801 | 10/1998 |

* cited by examiner

CLAMPING DEVICE FOR A SHAFT AND METHOD FOR CLAMPING SAME

CROSS-REFERENCE TO RELATED APPLICATIONS

This is a national stage of PCT/EP2010/067238 filed Nov. 10, 2010 and published in German, which claims the priority of German number 10 2009 052 411.8 filed Nov. 10, 2009, hereby incorporated by reference.

BACKGROUND OF THE INVENTION

1. Field of Invention

The invention relates to a clamping device for a shaft and a method for clamping thereof.

The device and method can firstly be used in any fields of technology. However, they are particularly suitable for storing and holding winding shafts. Here, the winding shaft train is a particular place of application.

2. Description of the Prior Art

In order to hold winding shafts at one side in the winding shaft train, clamping sockets with high clamping force are required.

For this purpose, prior art uses e.g., wedge-hook sockets, which are operated hydraulically and/or with very large pneumatic cylinders.

Alternatively, clamping device are used which are closed by motor-force using spindles.

A disadvantage of the prior art clamping devices described above is that while wedge-hook sockets may apply strong clamping forces, they only show a short stroke. Furthermore, such devices are very expensive.

Another disadvantage of the above-described prior art devices is that when they are operated hydraulically, a hydraulic aggregate is required as well. Additionally, hydraulic aggregates are not very welcome in the production of, e.g., food films, which are wound onto the respective winding device.

Yet another disadvantage of the prior art clamping devices is that the large pneumatic cylinders used alternatively are very expensive.

And, still another disadvantage of the prior art clamping devices is that when using clamping devices with spindle drives, although large displacement paths are given, at standard construction size their clamping force is relatively low. Another problem is the wear and tear of the spindle drives caused by the use and opening of the clamping device due to friction.

The objective of the present invention is therefore to suggest a device which corrects the described disadvantages of the device of prior art or at least reduces them.

SUMMARY OF THE INVENTION

According to the invention, this objective is attained in accordance with the features described herein. Accordingly the device comprises a lever, which is supported rotational about an axis. By this measure, the forces can be increased and it is possible to yield a wide range of adjustment.

A locally fixed positioning and/or a first axis is advantageous, extending parallel in reference to the holding position of the shaft to be held in its socket.

It is particularly advantageous to provide a device for defining a second rotary axis, by which the second rotary axis can be defined for the lever, as needed. This device also comprises components necessary to quasi switch on a second rotary axis to the lever ("switchable additional rotary axis"). This may occur by a body, showing a round and/or curved surface, is made to contact the lever with said surface.

Alternatively or additionally a bore or recess may be provided in the lever, engaging a body which then defines the second axis.

In particular with regards to the second axis it may occur that no considerable rotary motion occurs with regards to its extent about the second axis, rather that it only serves to create leverage, by which adequate clamping forces can be applied.

Stops may be provided, which in turn may be mobile. When they can be fixed in the effective range of the lever, they may influence the pivotal motion that can be performed by said lever. It is advantageous for the lever to be pressed against a clamping jaw, which in turn fixates the shaft.

In the embodiment of the method according to the invention it is advantageous for the lever, which is supported pivotal about a first axis, to be moved in reference to the shaft. Generally, when fixating the shaft the lever is moved towards it and when the shaft is released again the lever is moved away. Prior to performing the rotary motion about the lever, said lever can perform a linear motion in reference to the shaft.

Additional exemplary embodiments of the invention are discernible from the description of the figures and the claims.

BRIEF DESCRIPTION OF THE DRAWINGS

The individual figures show:

FIG. 1 An illustration of a device according to the invention in a first operating position FIG. 2 An illustration of a device according to the invention of FIG. 1 in a second operating position FIG. 3 An illustration of a device according to the invention of FIG. 1 in a third operating position FIG. 4 An illustration of a device according to the invention of FIG. 1 in a fourth operating position FIG. 5 An illustration of the device according to the invention of FIG. 1 in the fourth operating position, already shown in FIG. 4, with additional arrows being sketched in.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
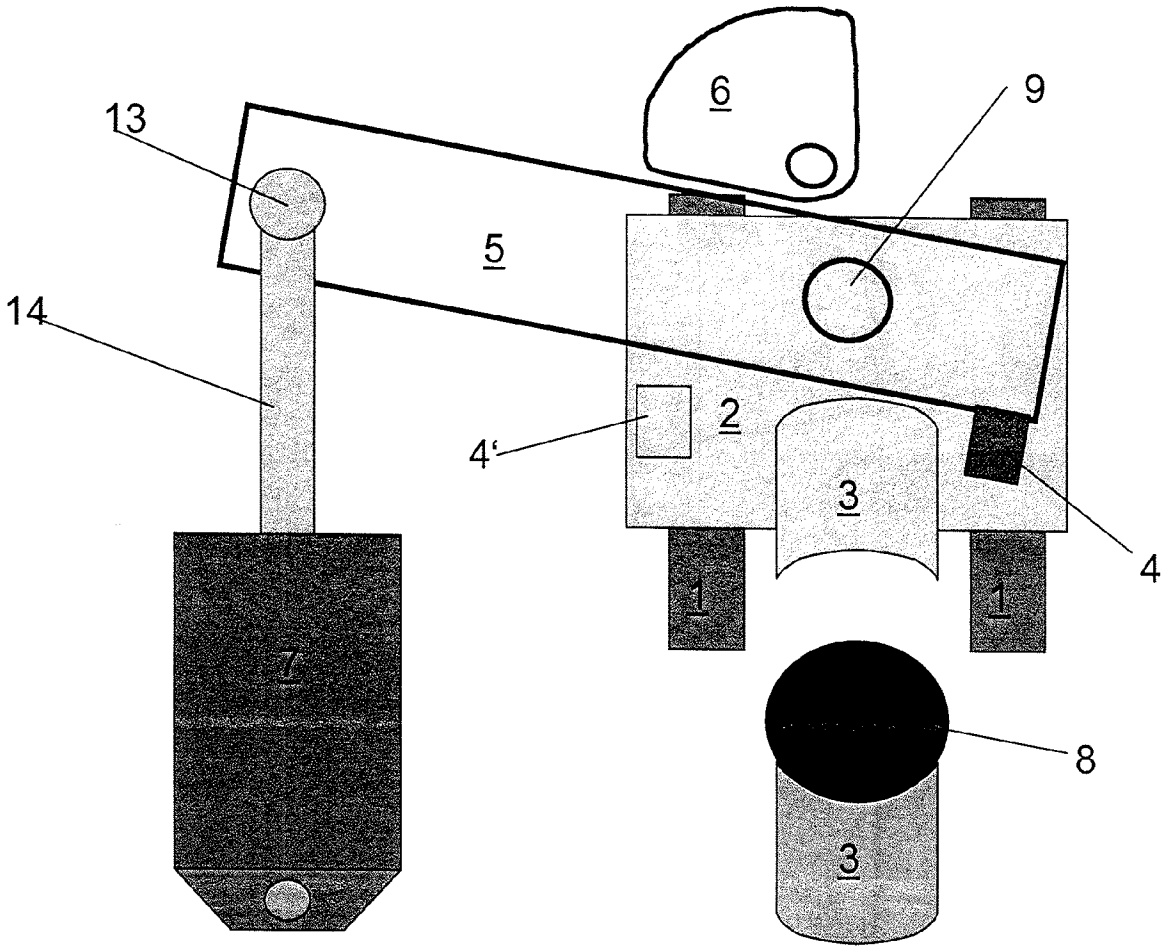

FIG. 1 shows an illustration of the device according to the invention in a first operating position, in which the shaft 8 such as a winding shaft), is located in the clamping jaw 3, without being held, here. Rails 1 are provided in the clamping device 19, on which the sled 2 can glide back and forth in the vertical direction. Using this sled, the stops 4, the clamping jaw 3, and the first axis 9 of the lever 5 are mobile. Long opening paths can be yielded in the device shown when appropriately long rails 1 of this type are used. The lever 5 can be subjected to an operating power by the cylinder 7, which preferably represents a pneumatic cylinder, via the piston 14 and the link 13 of the piston.

Figure 2:
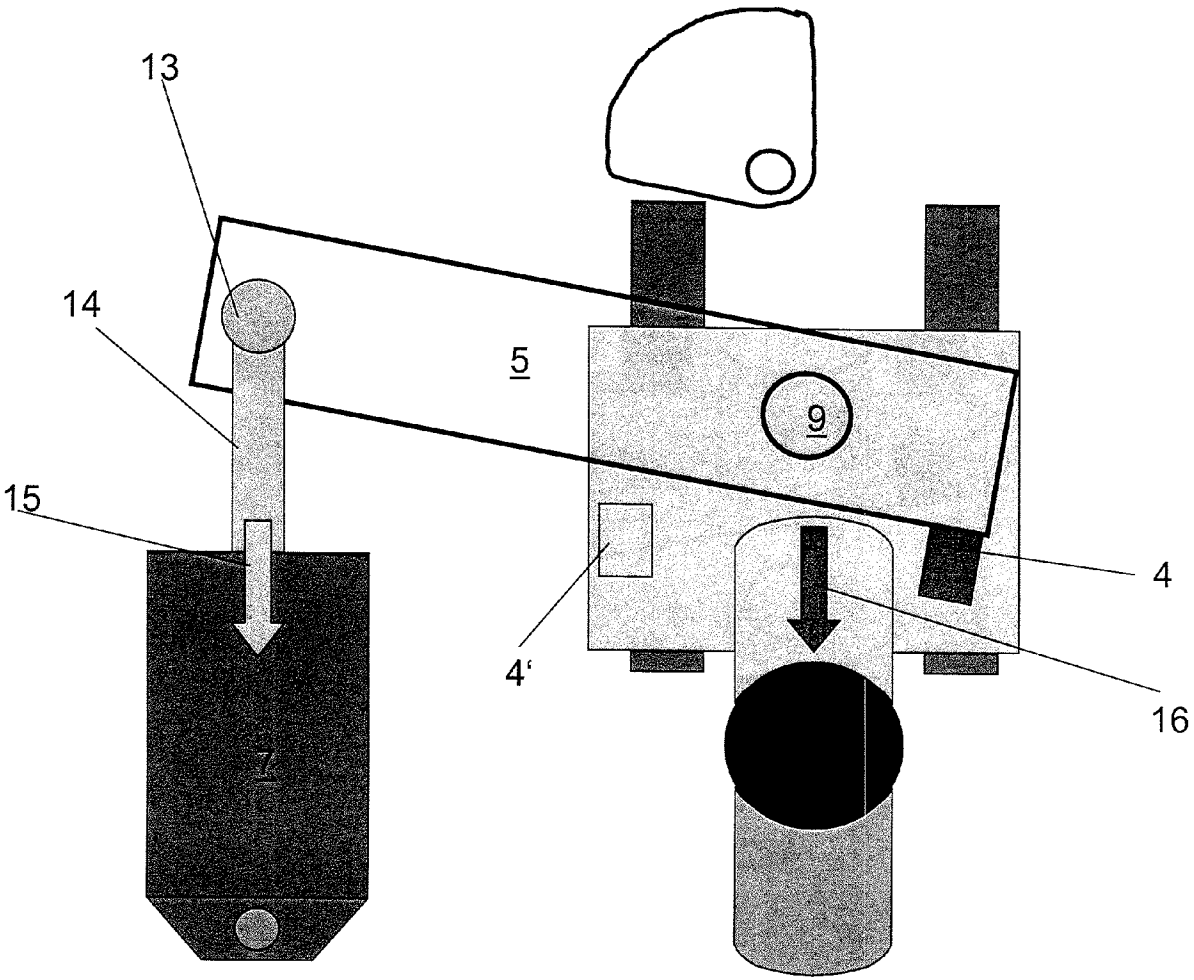
Figure 3:
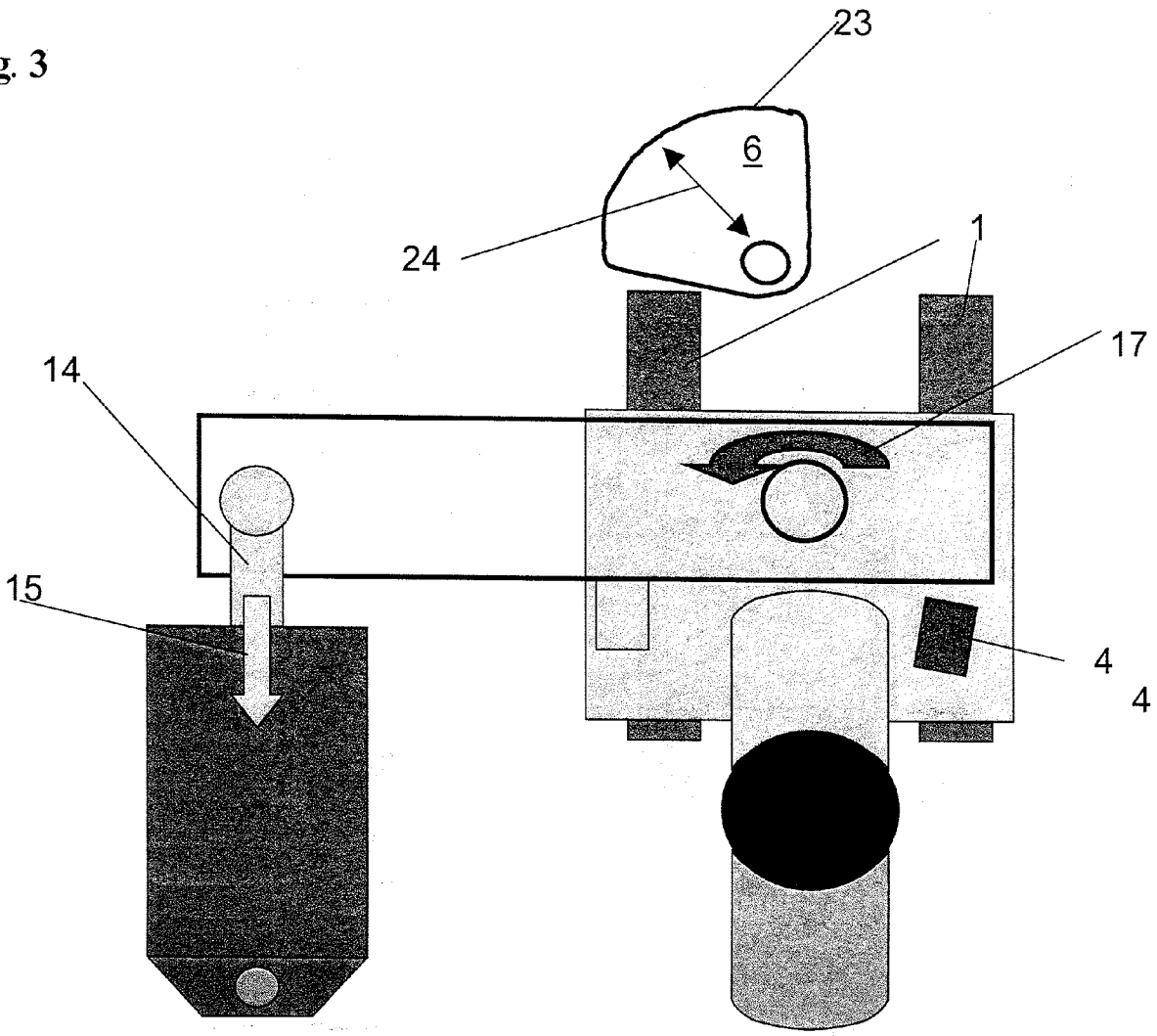
Figure 4:
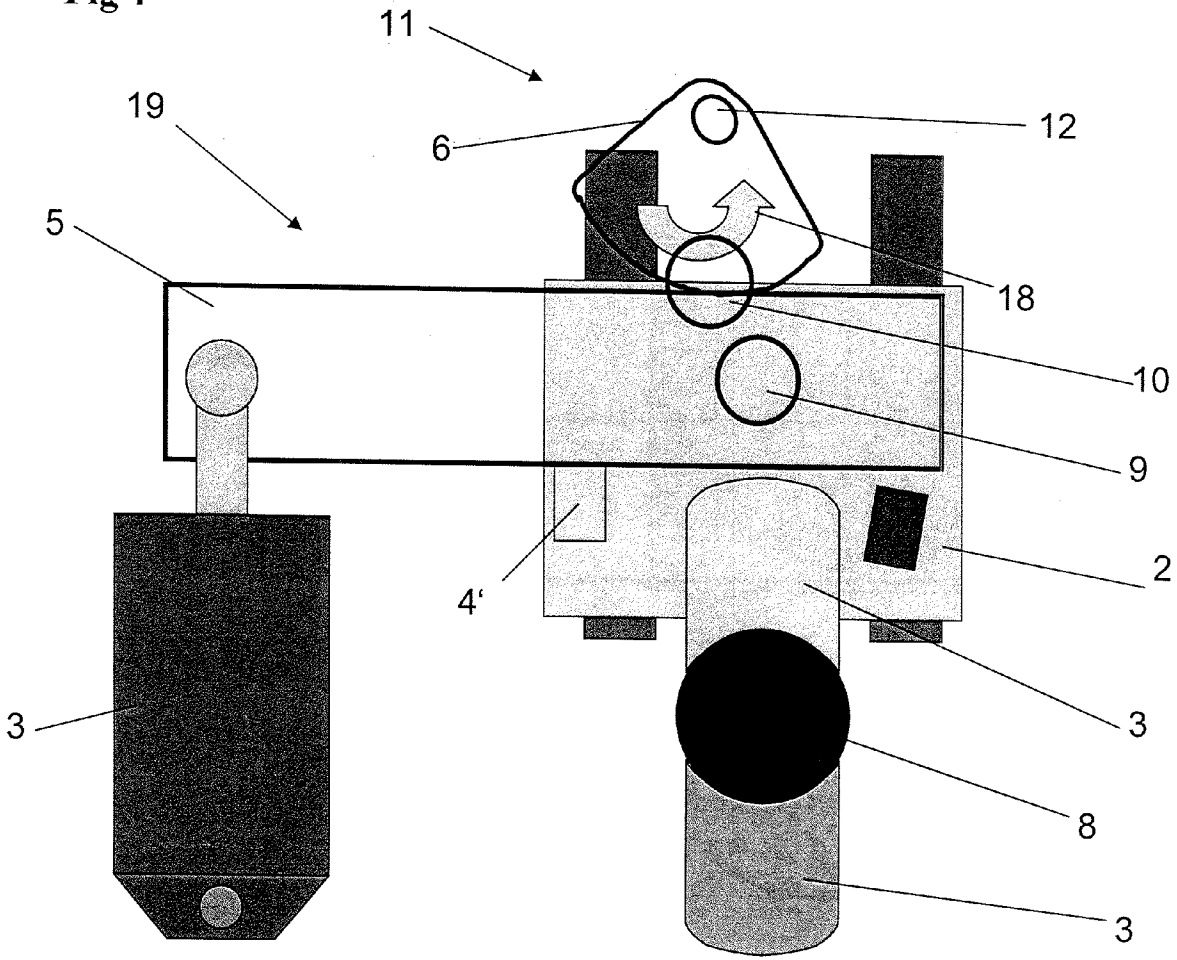

It is already discernible in FIG. 2 how the piston 14 of the cylinder 7 is inserted into the cylinder (arrow 15). Here, the motion of the sled 2 develops, indicated by the arrow 16, by which the clamping jaw 3 is made to contact the shaft 8. FIG. 3 shows how the situation in the cylinder 7 changes by the continuous motion of the piston 14 indicated by the arrow 15: After the translation of the sled has come to an end, because the clamping jaw 3 has reached the shaft, a minor additional rotation occurs, indicated by the arrow 17, about the first axis 9 until the lever 5 reaches the left stop 4'. The clamping forces upon the shaft 8 that can be created in this situation are limited, though, due to the lever ratio.

In this situation, the clamping disk 6 (i.e., a cam) is pivoted about the axis 12 into an operating position, as indicated by the arrow 18. Here, a second rotary axis 10 is defined, shown by the circle 10 and the [circle] 10 would move along the contact surface between the two bodies 5, 6 by the rolling motion of the lever 5 at the clamping disk 6. In the present exemplary embodiment, here the lever 5, the clamping disk 6, and its link 12 form the device to define a rotary axis 11. The link 12 is generally mounted in a fixed manner at the machine frame of the winding device and withstands large forces.

Figure 5:
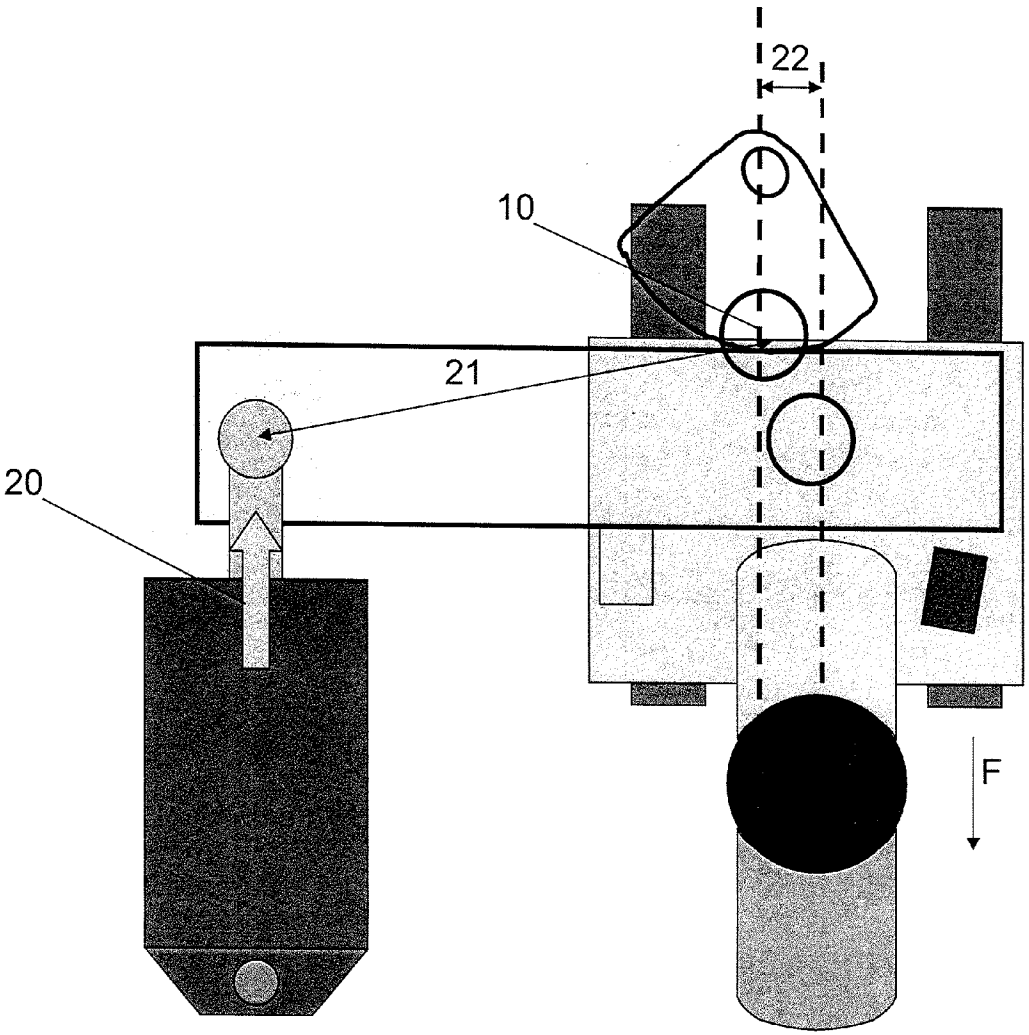

However, in the present exemplary embodiment no extensive motions are intended, rather the introduction of the second rotary axis 10 leads to a significant change of the lever ratios in reference to the situation in FIG. 3. Due to this circumstance the shaft 8 is clamped with a strong force when the piston 14 moves back out of the cylinder 7, as indicated by the arrow 20 in FIG. 5. The forces are based on the distance 21 between the second rotary axis 10 and the linking point 14 as well as the distance 22 of the second rotary axis 10 and the first axis 9 orthogonally in reference to the effective direction of the force F.

In order to release the shaft 8 the processes occur in the inverse sequence. For reasons of illustration, the lever 5 located in front of the sled 2 is shown clear, thus without any colored areas, while components, such as the sled, are shown with colored areas.

Summarizing the following can be stated with regards to the embodiment of the clamping device 19 described:

Large displacement paths with strong clamping forces are yielded with a relatively small pneumatic drive (cylinder 7) in the clamping device 19 shown.

Here, this clamping device 19 uses the following circumstances:

1. Firstly, large displacement paths are yielded to close and/or open the clamping device via a simple displacement of the pneumatic cylinder (FIGS. 1 through 3).
2. Then strong clamping forces are yielded by "adding or guiding thereto" an additional rotary point 10 and the lever ratios resulting therefrom.

The advantages of the device 19 therefore include:

strong clamping forces can be yielded;

large displacement paths can be yielded;

small pneumatic drives can be used (e.g., small adjustment paths);

by the additional rotary point 10 a mechanic safety against opening the clamping device 19 is given in case of a loss of energy supply;

the device 19 can be produced in a relatively cost-effective manner.

Additional advantages can be achieved when the incline of the clamping disk 6 is varied at its circumferential area 23. When this incline is minor, e.g., immediately in the proximity of the point at which the shaft 8 is fixed (frequently at the point where the distance of the circumferential area 23 from the point of rotation 12 of the clamping disk 6 is greatest, preferably smallest in reference to the other circumferential areas), a strong closing force can be achieved with the clamping disk 6 as well.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

LIST OF REFERENCE CHARACTERS

1 Guiding Rails
2 Guiding Sled
3 Clamping Jaw/Accept for the Shaft 8
4, 4' Stops
5 Clamping Lever
6 Cam (spiral)
7 Cylinder
8 Winding Shaft
9 First Axis
10 Second Axis
11 Device to Define a Rotary Axis
12 Point/axis of Rotation of the Clamping Disk
13 Link of the Piston to the Lever
14 Piston
15 Arrow
16 Arrow
17 Arrow
18 Arrow
19 Clamping Device
20 Arrow
21 Distance Between 13 and 10
22 Distance Horizontal Between 10 and 9
23 Circumference of the Cam 6
24 Distance Between the Circumference 23 of the Cam 6 and the Point/Axis of Rotation 12 of the Cam 6
F Direction of Influence of the Clamping Force Upon the Shaft 8

What is claimed is:

1. A device for holding a winding shaft, said device comprising:

a clamping element that fixedly holds the winding shaft;

a lever that is rotationally supported about a first axis, the first axis being displaceably positioned relative to a portion of the clamping element; and a clamping disk configured as a cam, with the lever and the clamping disk defining a second axis.

2. The device according to claim 1, wherein the first axis extends parallel to a holding position of the winding shaft.

3. The device according to claim 1, wherein the clamping disk is pivotable about a clamping disk axis.

4. The device according to claim 1, wherein the lever has a bore therein that defines the first axis.

5. The device according to claim 1, further comprising at least one stop that acts against the lever in an operating motion thereof.

6. The device according to claim 1, wherein the lever imparts a force to the clamping element with which the clamping element can fixedly hold the winding shaft.

7. The device according to claim 1, further comprising at least one cylinder.

8. The device according to claim 7, wherein the cylinder is a pneumatic cylinder.

9. The device according to claim 7, wherein the cylinder actuates a movement of the lever.

10. The device according to claim 1, wherein a direction of transportation defines movement of the first axis relative to the winding shaft.

11. A method of holding a winding shaft with a device including a clamping element that fixedly holds the winding shaft, and a lever that is rotationally supported about a first axis, the first axis being displaceably positioned relative to a portion of the clamping element, said method comprising in sequence the following steps:

imparting a rotary motion of the lever about the first axis; defining a second axis; and imparting a rotary motion of the lever about the second axis with a cam.

12. The method according to claim 11, further comprising, prior to the step of imparting the rotary motion of the lever about the first axis, a step of moving the first axis in a direction toward the winding shaft.

13. The method according to claim 12, wherein during the step of moving the first axis in the direction toward the winding shaft, at least one stop and at least one clamping element are entrained.

14. A device for holding a winding shaft, said device comprising:

a clamping element having a first portion and second portion, said clamping element being configured to fixedly hold the winding shaft;

a lever that is rotationally supported about a first axis; and a movable sled mounted on rails, with the first portion of the clamping element, the lever, and the first axis being displaceably positionable relative to the winding shaft and the second portion of the clamping element via movement of the sled along the rails.

15. The device according to claim 14, further comprising an element that imparts a force to the lever so as to rotate the lever about the first axis, and wherein the rotated lever imparts a force to the clamping element with which the clamping element fixedly holds the winding shaft.

16. The device according to claim 15, wherein the element that imparts the force to the lever includes a pneumatic cylinder, a piston, and a link to the lever.

* * * * *